US006685438B2

(12) United States Patent
Yoo et al.

(10) Patent No.: US 6,685,438 B2
(45) Date of Patent: Feb. 3, 2004

(54) APPARATUS AND METHOD FOR CONTROLLING OPERATION OF RECIPROCATING COMPRESSOR

(75) Inventors: Jae Yoo Yoo, Kyounggi-Do (KR); Chel Woong Lee, Seoul (KR); Min Kyu Hwang, Kyounggi-Do (KR)

(73) Assignee: LG Electronics Inc., Seoul (KR)

( * ) Notice: Subject to any disclaimer, the term of this patent is extended or adjusted under 35 U.S.C. 154(b) by 60 days.

(21) Appl. No.: 10/153,636

(22) Filed: May 24, 2002

(65) Prior Publication Data

US 2003/0026703 A1 Feb. 6, 2003

(30) Foreign Application Priority Data

Aug. 1, 2001 (KR) ..... 2001/46573
Aug. 1, 2001 (KR) ..... 2001/46575

(51) Int. Cl.[7] ..... F04B 49/06

(52) U.S. Cl. ..... 417/44.11; 417/44.1; 417/44.8; 417/45; 417/22; 417/415; 417/53

(58) Field of Search ..... 417/44.11, 44.1, 417/44.8, 45, 42, 22, 18, 415, 53

(56) References Cited

U.S. PATENT DOCUMENTS 5,549,456 A * 8/1996 Burrill et al. ..... 417/12
5,736,823 A * 4/1998 Nordby et al. ..... 417/44.11
5,980,211 A * 11/1999 Tojo et al. ..... 417/45
6,264,432 B1 * 7/2001 Kilayko et al. ..... 417/44.1
6,501,240 B2 * 12/2002 Ueda et al. ..... 318/135
6,541,953 B2 * 4/2003 Yoo et al. ..... 417/44.11

* cited by examiner

*Primary Examiner*—Justine R. Yu
*Assistant Examiner*—Michael K. Gray
(74) *Attorney, Agent, or Firm*—Birch, Stewart, Kolasch & Birch, LLP

(57) ABSTRACT

In an operation control apparatus of a compressor, a current, a voltage an d a TDC, etc. applied to a compressor are detected, a speed and a TDC are constantly controlled so as to place an operation point of the compressor within a high efficiency operation region by using a phase difference between each detected values (for example, a phase difference between the current and the voltage), and an operation frequency is varied according to a load variation, accordingly an operation efficiency of the compressor can be improved.

28 Claims, 9 Drawing Sheets

LOAD1 > LOAD 2 > LOAD 3

FREQUENCY 3 > FREQUENCY 2 > FREQUENCY 1

APPARATUS AND METHOD FOR CONTROLLING OPERATION OF RECIPROCATING COMPRESSOR

BACKGROUND OF THE INVENTION

1. Field of the Invention

The present invention relates to an apparatus and a method for controlling operation of a reciprocating compressor, and in particular to an apparatus and a method for controlling operation of a reciprocating compressor which are capable of improving an operational efficiency of a compressor by varying an operation frequency.

2. Description of the Prior Art

A general reciprocating compressor (hereinafter, it is referred to as a compressor) performs a reciprocating motion of a mover by supplying a sine wave voltage or a rectangular pulse wave voltage to a stator coil in turns and repeatedly applying a certain linear stroke to the mover. In more detail, when a serial current flows to the stator coil, the stator's iron core is magnetized and turned into an electromagnet. Then, the mover made of an iron core and supporting an air gap with a bearing is magnetized and moved by a suction force. Next, when a current direction of the stator is changed, the operational direction of the suction force acting on the mover is changed, and the mover is moved into the opposite direction. As described above, if an excitation current direction of the stator is continuously changed by turns, the mover performs the reciprocating motion continually.

FIG. 1 is a block diagram illustrating a construction of a general apparatus for controlling operation of a compressor. As depicted in FIG. 1, the general apparatus includes a linear compressor 150 adjusting a freezing capacity by moving a piston up and down by a voltage applied to the compressor in accordance with a stroke reference value, a voltage detecting unit 130 detecting a voltage applied to the compressor 150 according to an increase of a stroke, a current detecting unit 120 detecting a current applied to the compressor 150 according to the increase of the stroke, a microcomputer 140 calculating a stroke by using the detected voltage and current, comparing the calculated stroke with a stroke reference value and outputting a control signal according to the comparison result, and an electric circuit unit 110 intermitting AC power to a triac according to the control signal of the microcomputer 140 and applying a voltage to the compressor 150.

In the compressor 150, because the piston moves up and down by a voltage applied according to the stroke reference value set by a user, a stroke can be varied, accordingly a freezing capacity can be adjusted.

The stroke increases by lengthening a turn-on cycle of the triac of the electric circuit unit 110 according to the control signal from the microcomputer 140. Herein, the voltage detecting unit 130 and the current detecting unit 120 respectively detect the voltage and the current applied to the compressor 150 and apply them to the microcomputer 140.

Then, the microcomputer 140 calculates a stroke by using the voltage and the current, compares the stroke with the stroke reference value and outputs a control signal according to the comparison result. In more detail, when the stroke is smaller than the stroke reference value, the microcomputer 140 increases a voltage applied to the compressor 150 by outputting a control signal for lengthening an on cycle of the triac, when the stroke is greater than the stroke reference value, the microcomputer 140 decreases a voltage applied to the compressor 150 by outputting a control signal for shortening the on cycle of the triac, However, since the reciprocating compressor control apparatus according to the conventional art has a severe non-linearity in its mechanical motion characteristics, the operation of the reciprocating compressor can not be performed precisely and accurately by a linear control method without considering the non-linearity.

An operational efficiency of the compressor can be improved by controlling a phase difference between a current and a stroke uniformly, however when the compressor is continually operated, its operational efficiency may be lowered according to a load variation due to circumstances changes.

SUMMARY OF THE INVENTION

Accordingly, it is an object of the present invention to improve an operation efficiency of a compressor by controlling an operation speed constantly so as to place an operation point of the compressor within a high efficiency operation region by using a phase difference between a piston speed and a current and varying an operation frequency according to a load variation.

In addition, it is another object of the present invention to improve an operation efficiency of the compressor by controlling a TDC (top dead center) constantly so as to place an operation point of the compressor within a high efficiency operation region by using a phase difference between a piston speed and a current and varying an operation frequency according to a load variation.

In order to achieve the above-mentioned objects, an apparatus for controlling operation of a compressor includes a detecting means for detecting various elements related to an operation efficiency of a compressor; a phase difference comparing means for comparing phases of the elements each other and outputting a phase difference according to the comparison; an operation frequency determining means for determining a frequency at a certain time point as an operation frequency by increasing/decreasing a reference operation frequency by a certain frequency units according to the phase difference; an operation reference value determining means for determining an operation reference value according to the operation frequency outputted from the operation frequency determining means; and a control means for comparing the operation reference value with the elements detected by the detecting means, applying a control signal according to the comparison result to the compressor and varying an operation frequency of the compressor according to the operation frequency determined by the operation frequency determining means.

A method for controlling operation of a compressor includes operating a compressor with a reference frequency; determining a speed at an inflection point as a speed reference value after calculating the inflection point by using a phase difference between a piston speed of a compressor and a current applied to the compressor; operating the compressor according to the speed reference value; and varying an operation frequency of the compressor when a load variation occurs and varying the speed reference value according to the varied operation frequency.

A method for controlling operation of a compressor includes operating a compressor with a reference frequency; determining a TDC (top dead center) at an inflection point as a TDC reference value after calculating the inflection point by using a phase difference between a power voltage and a current; operating the compressor according to the TDC reference value; and varying an operation frequency of the compressor when a load variation occurs and varying the TDC reference value according to the varied operation frequency.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

In an operation control apparatus of a compressor and a method thereof in accordance with the present invention, a current or a voltage applied to a compressor through a detecting means or a speed of a piston or a TDC (top dead center) are respectively detected, it is compared with an operation reference value outputted from an operation reference value determining unit, and an input voltage applied to the compressor is controlled according to the comparison result. In addition, a point as TDC=0 (phase difference inflection point) is detected through a phase difference comparing means, and a TDC or a piston speed (compressor speed) at the point is set as an operation reference value by an operation reference value determining means. In addition, when a load variation occurs in the compressor, an operation frequency is determined so as to operate the compressor within a high efficiency operation region by an operation frequency determining means, and it is applied to the operation reference value determining means. Then, the operation reference value determining means applies the operation frequency and the operation reference value corresponded to it to a control means. The control means varies an operation frequency of the compressor and varies an input voltage according to the operation reference value. Accordingly, an operation efficiency of the compressor is improved.

Hereinafter, an apparatus and a method for controlling operation of a compressor in accordance with the present invention will be described in detail with reference to accompanying drawings.

Figure 1:
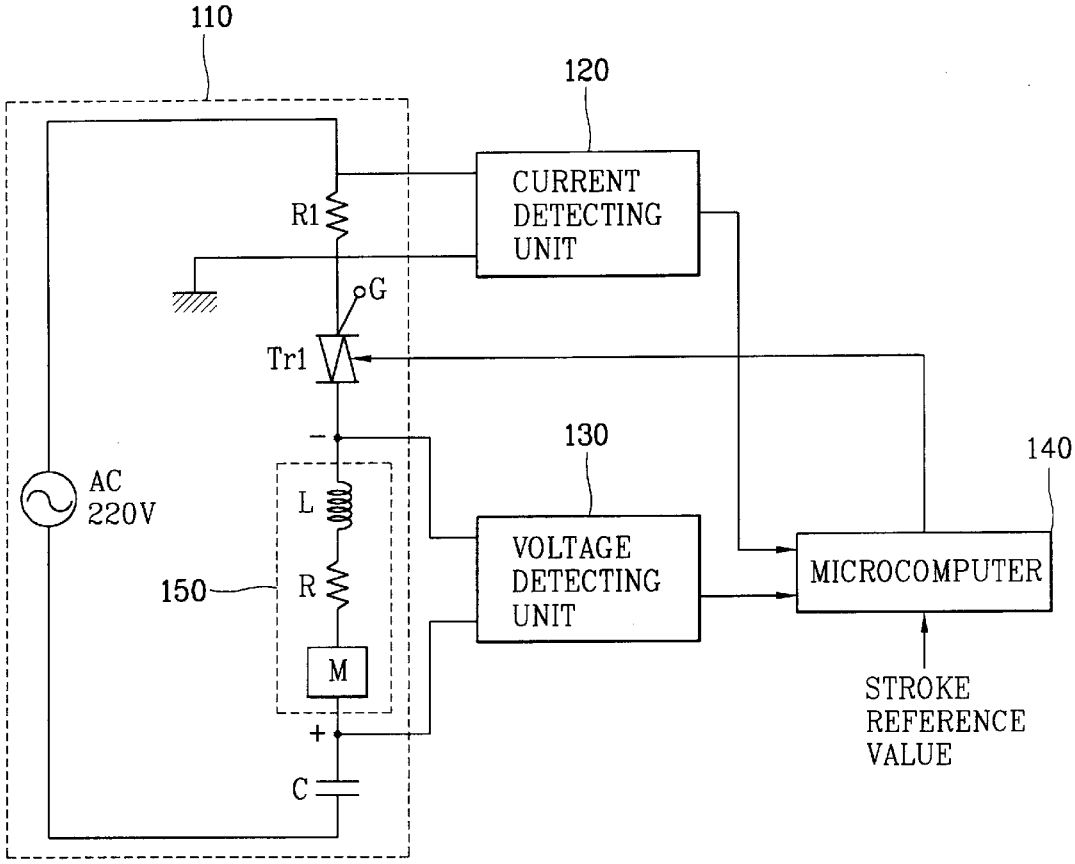
FIG. 1 BACKGROUND ART
FIG. 1 is a block diagram illustrating a construction of a general operation control apparatus of a compressor.
Figure 2:
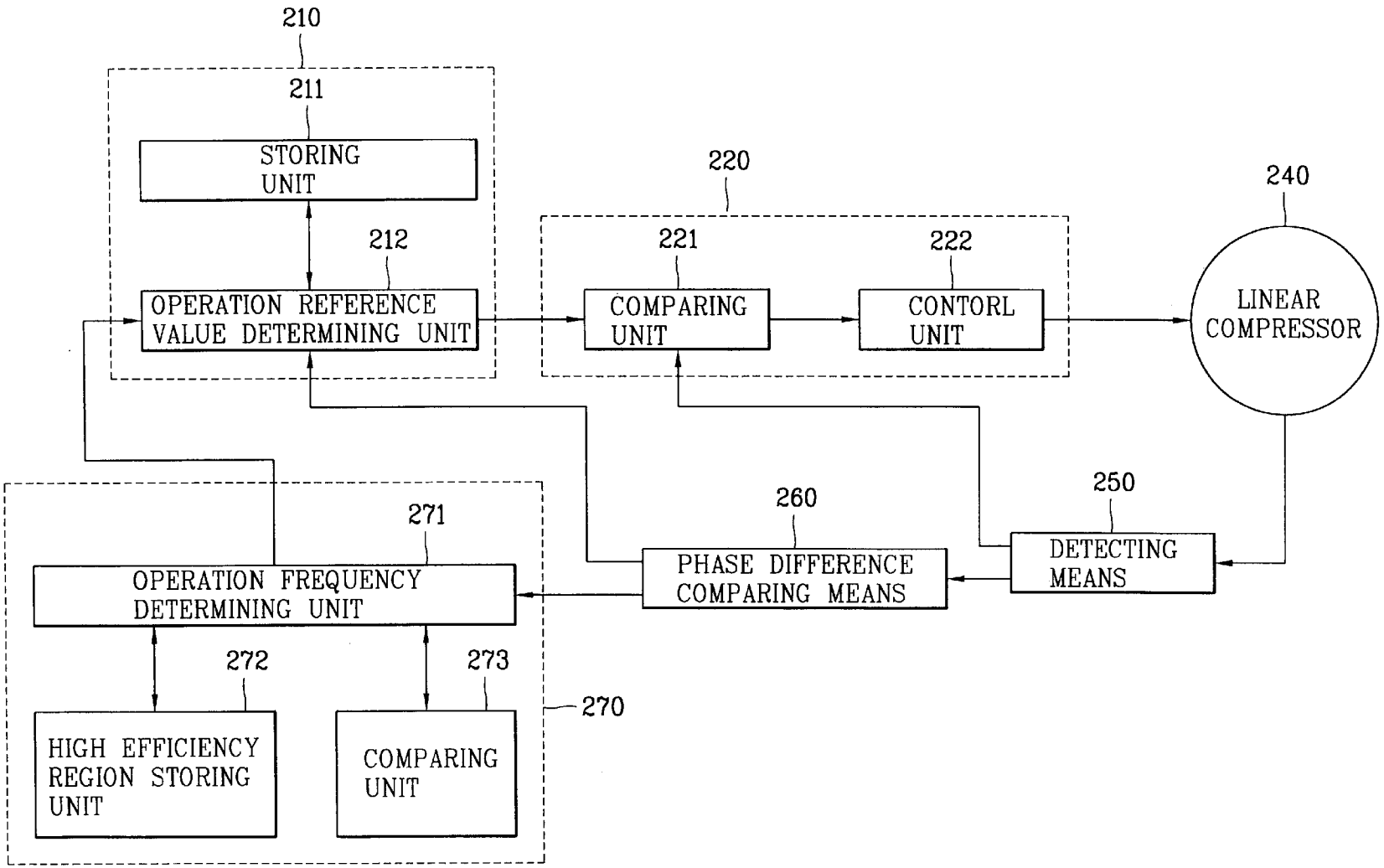
FIG. 2 is a block diagram illustrating an operation control apparatus of a compressor in accordance with the present invention.

FIG. 2 is a block diagram illustrating an operation control apparatus of a compressor in accordance with the present invention. As depicted in FIG. 2, an apparatus for controlling operation of a compressor includes a detecting means 250 respectively detecting a current/voltage applied to a compressor, a piston (compressor) speed and a TDC (top dead center), a phase difference comparing means 260 for comparing a phase of the current with a phase of the voltage or a phase of the piston (compressor) speed with a phase of the current, an operation frequency determining means 270 for determining a frequency at a certain time point as an operation frequency by increasing/decreasing a reference operation frequency by a certain frequency units, an operation reference value determining means 210 for determining a piston (compressor) speed reference value or a TDC reference value according to the operation frequency outputted from the operation frequency determining means 270, and a control means 220 applying the operation frequency determined by the operation frequency determining means 270 to the compressor, comparing the speed reference value determined by the operation reference value determining means 210 or a TDC reference value with each value detected by detecting means 250 and applying a control signal according to the comparison result.

The operation frequency determining means 270 includes an operation frequency determining unit 271 for compensating an operation frequency corresponded to a mechanical resonance frequency varied according to a load variation of the compressor, a high efficiency region storing unit 272 detecting a high efficiency phase difference region performable high efficiency operation through experiments and storing it, and a comparing unit 273 for determining whether a phase difference of the phase difference comparing means 260 places within the high efficiency phase difference region.

The operation reference value determining means 210 includes an operation reference value determining unit 212 for determining a piston (compressor) speed, a TDC (top dead center) or a stroke reference value according to an operation frequency outputted from the operation frequency determining unit 271 and a storing unit 211 for storing a piston (compressor) speed, a TDC or a stroke by each operation frequency through experiments.

In addition, the control means 220 includes a comparing unit 221 comparing the operation reference value applied from the operation reference value determining means 210 with a result value detected from the detecting means 250, an input voltage varying means (not shown) for varying a voltage applied to the compressor according to the comparison result, and an operation frequency varying means (not shown) for varying an operation frequency of the compressor according to the operation frequency applied from the operation frequency determining means 270.

The operation of the operation control apparatus of the compressor in accordance with the present invention will be described.

First, the detecting means 250 respectively detects a current/voltage applied to the compressor 240, a piston (compressor) speed and a TDC. Then, the phase difference comparing means 260 compares a phase of the piston (compressor) speed with a phase of the current applied to the compressor 240 and applies a difference value to the operation frequency determining means 270. Herein, the phase difference comparing means 260 compares a phase of the power voltage (220V/60Hz, 220V/50Hz, 110V/60Hz, 110V/50Hz) with a phase of the current applied to the compressor 240 besides a phase difference between the piston (compressor) speed and the current applied to the compressor 240. In the reference phase difference (namely, phase difference as a reference of the high efficiency region in the comparison result of the phase difference comparing means 260), a phase difference between the current and the voltage applied to the compressor 240 is 0°.

Herein, when the compressor 240 has a mechanical resonance, the high efficiency region storing unit 272 detects a region within±δ (a certain value) on the basis of a phase difference between the current applied to the compressor 240 and the piston (compressor) speed or the current applied to the compressor 240 and the power voltage through experiments and pre-stores it. Herein, the certain value is set through experiments in order to facilitate detecting an inflection point about a phase difference between the piston (compressor) speed and the current applied to the compressor.

The comparing unit 273 receives a phase difference between the compressor speed and the current applied to the compressor 240 from the operation frequency determining unit 271, checks whether the phase difference places within a high efficiency operation region and applies a control signal according to the comparison result to the operation frequency determining unit 271.

When the load of the compressor 240 is varied, the operation frequency determining unit 271 increases/decreases the reference operation frequency by a certain frequency units in order to place the phase difference curve between the compressor speed and the current applied to the compressor 240 within the high efficiency region. When the phase difference curve places within the high efficiency region, a frequency at that time point is determined as an operation frequency, and it is applied to the operation reference value determining unit 212. According to this, the operation reference value determining unit 212 receives the operation frequency outputted from the operation frequency determining unit 271 and determines an operation reference value corresponded to it. In addition, the operation frequency is applied to the control means 220. In more detail, the piston (compressor) speed applied to the compressor 240 or a TDC by each frequency is pre-stored in the storing unit 211 through experiments, an operation reference value is determined by calculating a piston and a TDC corresponded to the operation frequency outputted from the operation frequency determining unit 270.

Then, the control means 220 receives a reference value outputted from the reference value determining means, compares the reference value with a present piston (compressor) speed or a TDC detected in the detecting means 250 and varies the operation frequency by applying a control signal according to the comparison result to the compressor 240. Accordingly, the compressor 240 is operated according to the varied operation frequency.

The operation of the operation control apparatus of the compressor will be described in more detail with reference to accompanying drawings.

First, a relation between the load variation and the operation efficiency of the compressor 240 will be described.

Figure 3:
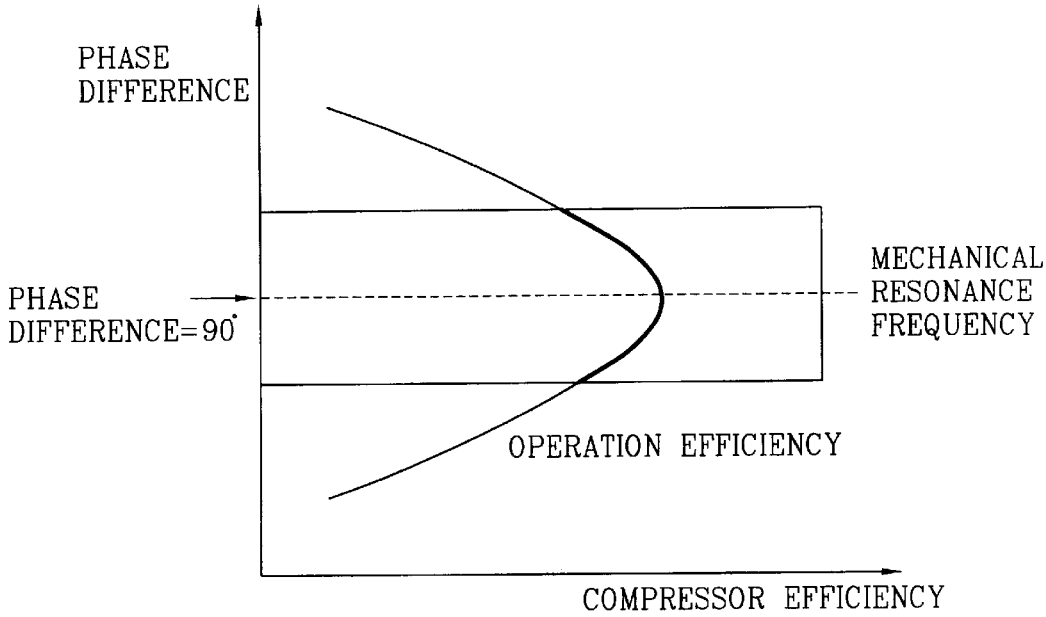
FIG. 3 is a graph illustrating a high efficiency operation region of a compressor in accordance with the present invention.

FIG. 3 is a graph illustrating a high efficiency operation region of the compressor 240. As depicted in FIG. 3, at a point having a 0° phase difference (phase difference between the current and the voltage applied to the compressor is 0°) calculated by the phase difference comparing means 260, a mechanical resonance frequency of the compressor 240 coincides with the operation frequency. Herein, the operation frequency of the compressor 240 is maximum.

Figure 4:
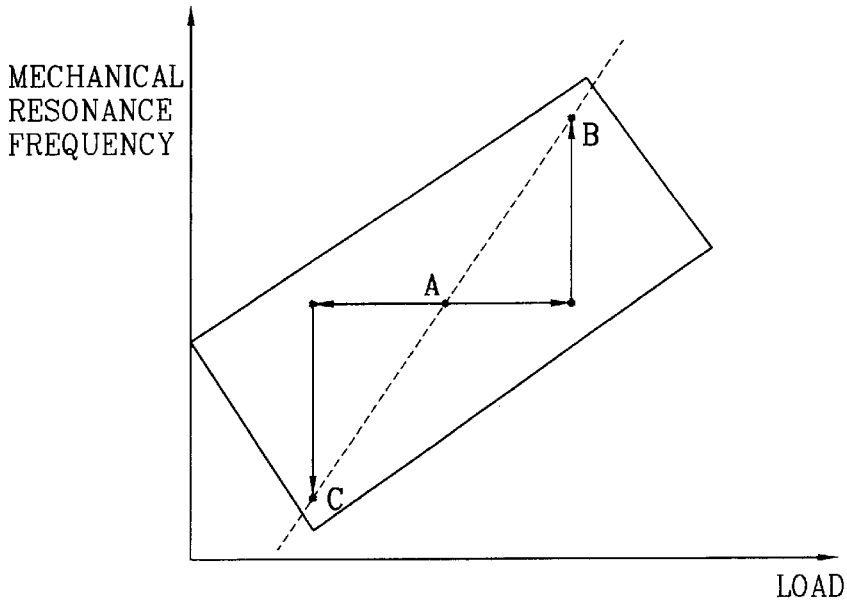
FIG. 4 is a graph illustrating variation of a mechanical resonance frequency according to a load variation.

FIG. 4 is a graph illustrating variation of a mechanical resonance frequency according to a load variation. As depicted in FIG. 4, if a piston (compressor) speed and a TDC are constant, when a load of the compressor 240 increases, an operation point of the compressor 240 is moved from 'A' into 'B'. In more detail, a mechanical resonance frequency increases. However, when a load of the compressor 240 decreases, the operation point of the compressor 240 is moved from 'A' into 'C'. In other words, a mechanical resonance frequency decreases. As described above, when a mechanical resonance frequency is varied according to the load variation of the compressor 240, an operation region at which the compressor 240 can have a maximum efficiency is varied.

Figure 5A:
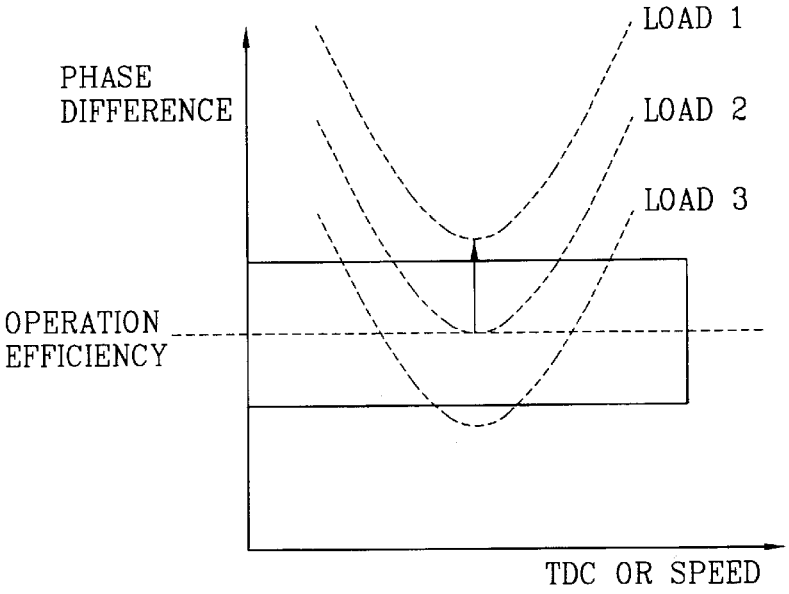
FIG. 5A is a graph illustrating variation of an operation point of the compressor according to a load increase.
Figure 5B:
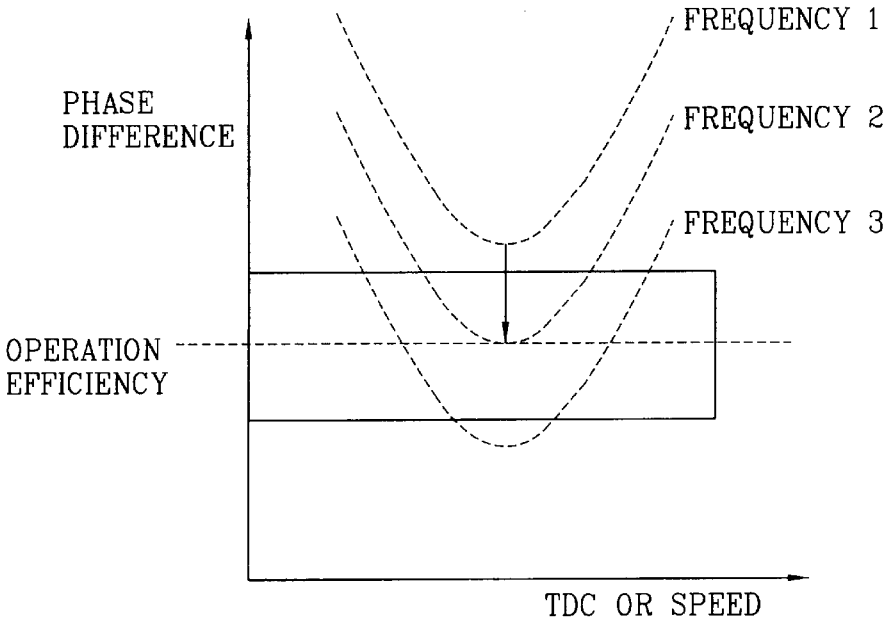
FIG. 5B is a graph illustrating variation of an operation point of the compressor according to an operation frequency increase in FIG. 5A.

FIGS. 5A and 5B are graphs illustrating moving of an inflection point of a phase difference between a piston (compressor) speed and a current applied to the compressor when an operation frequency increases according to an increase of the load of the compressor. As depicted in FIGS. 5A and 5B, although the compressor 240 is operated in the high efficiency operation region, when the load increases, the compressor 240 is operated out of the high efficiency operation region. Herein, when the operation frequency increases constantly, the compressor 240 is operated within the high efficiency operation region again.

EXAMPLES

Example 1

Figure 6:
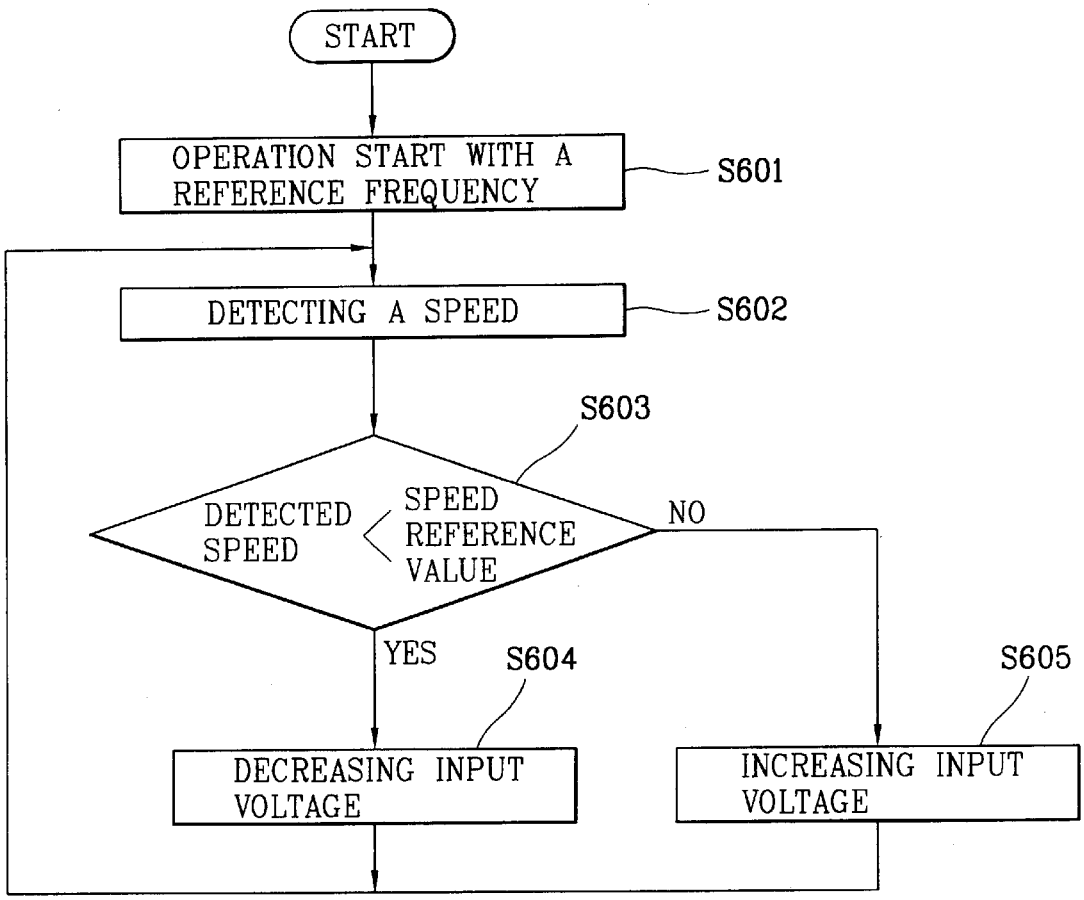
FIG. 6 is a flow chart illustrating a speed control of the operation control apparatus of the compressor in accordance with the present invention.
Figure 7:
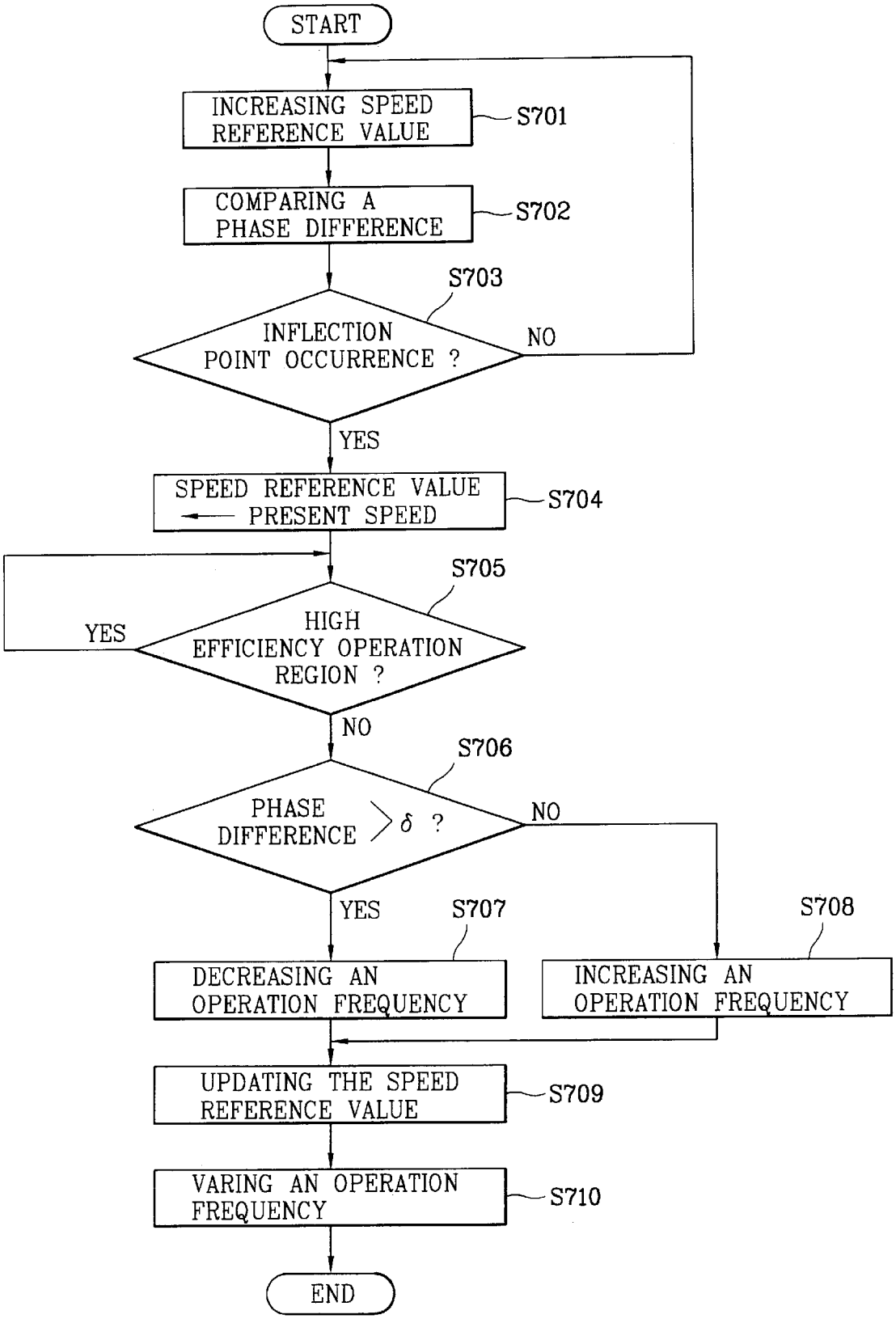
FIG. 7 is a flow chart illustrating an operation control method of a compressor in accordance with an embodiment of the present invention.

As depicted in FIGS. 6 and 7, in the operation control apparatus of the compressor 240, a speed of the compressor 240 is detected through the detecting means 250, is compared with a speed reference value determined by the operation reference value determining unit 212, and a voltage applied to the compressor 240 is controlled in order to compensate the difference. At the same time, a phase difference between the piston (compressor) speed and the current applied to the compressor 240 is calculated, the speed reference value increases on the basis of the calculated phase difference until an inflection point occurs on the phase difference curve in order to find a speed point having a maximum operation efficiency of the compressor 240, the found speed point is determined as a speed reference value. When the speed reference value is determined, the compressor 240 is continually operated at the point. However, when a load of the compressor 240 is varied, a mechanical resonance frequency of the compressor 240 is varied, the operation point of the compressor 240 places out of the high efficiency operation region. In order to compensate it, an operation frequency is varied according to the load variation. Accordingly, the operation point is returned to the high efficiency region (cycle of 10~60 seconds).

In more detail, as depicted in FIG. 6, when the operation of the compressor 240 is started with the reference frequency, the detecting means 250 detects the piston (compressor) speed and applies it to the control means 220 as shown at steps S601, S602. Then, the control means 220 receives the speed reference value applied from the operation reference value determining unit 212, compares the detected compressor speed with the speed reference value, if the detected speed is greater than the speed reference value, an input voltage decreases, if the detected speed is smaller than the speed reference value, an input voltage increases in order to place the early set operation point within a high efficiency operation region as shown at steps S603~S605. Herein, the high efficiency operation region of the compressor 240 is a region separated as±δ (a certain value) from a point as TDC=0 (phase difference of 90°).

Herein, the compressor 240 is controlled at a speed corresponded to a frequency of a power voltage (60 times control per second at 60Hz power voltage), the speed control is continued while compressor 240 is operated.

As depicted in FIG. 7, the operation reference value determining unit 212 increases the speed reference value, the phase difference comparing means 260 compares a phase difference between the piston (compressor) speed with the current applied to the compressor 240. If an inflection point occurs on the phase difference curve, the piston (compressor) speed is applied to the operation reference value determining unit 212. Then, the operation reference value determining unit 212 determines the speed as a speed reference value, applies it to the control means 220 and operates the compressor at the speed constantly through the control method as shown at steps S701~S704.

However, the load variation of the compressor 240 occurs due to a variation of circumstances, the mechanical resonance frequency increases or decreases according to it. Then, the phase difference comparing means 260 detects the load variation through the phase difference between the compressor speed and the current applied to the compressor 240 and applies a phase difference value according to the load variation to the operation frequency determining unit 271 as shown at step S705. Herein, the load variation is detected according to whether the phase difference between the stroke and the current applied to the compressor places within a certain high efficiency operation region or a phase difference between the piston (compressor) speed and the current applied to the compressor places within a certain high efficiency operation region or a phase difference between a voltage and a current applied to the compressor places within a certain high efficiency operation region.

After that, the operation frequency determining unit 271 determines a compensated operation frequency through the phase difference comparing means 260 and applies it to the operation reference value determining unit 212. In more detail, as depicted in FIGS. 5A and 5B, when a phase difference is greater than an upper limit, the operation frequency increases, when a phase difference is smaller than a lower limit, the operation frequency decreases as shown at steps S706~S708. Herein, a high efficiency operation region for performing a high efficiency operation is detected through experiments and pre-stored in the storing unit 211. And, a frequency corresponded to the varied operation frequency is determined as a speed reference value through the storing unit 211 and applied to the control means 220. Then, the control means 220 varies an input frequency and an input voltage according to the speed reference value, accordingly the compressor 240 is continually operated in the high efficiency operation region as shown at steps S709, S710.

Figure 8:
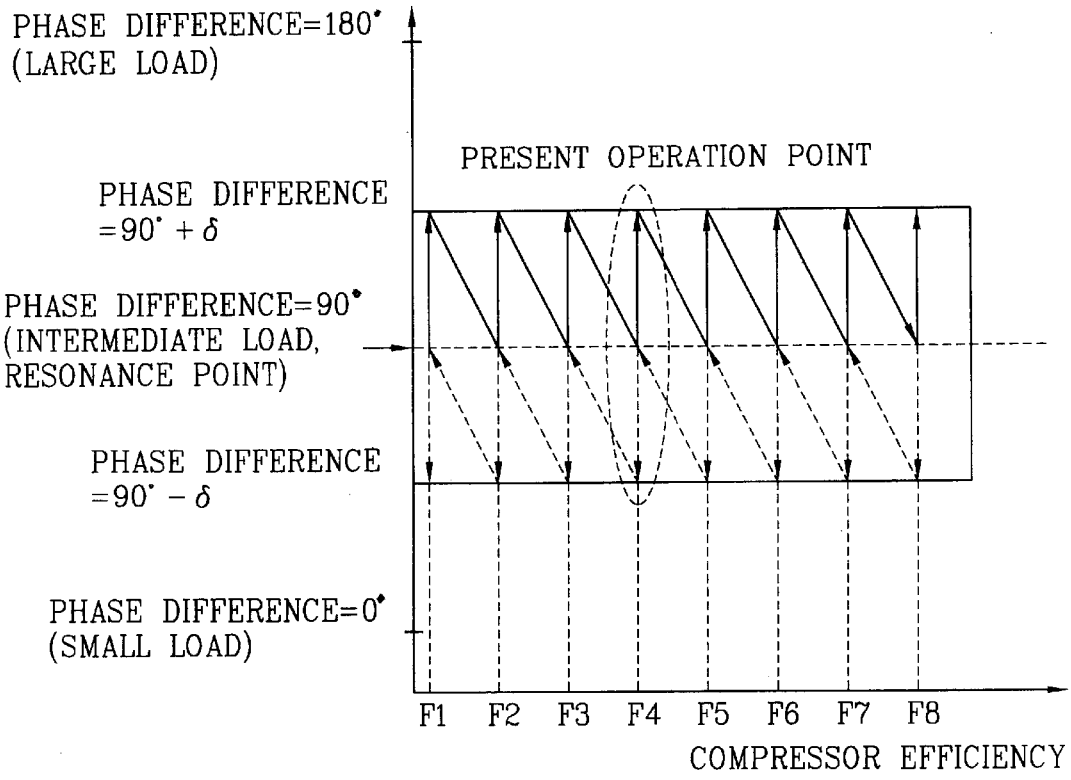
FIG. 8 is a graph illustrating increase/decrease of an operation frequency according to a size of a load.

FIG. 8 is a graph illustrating increase/decrease of an operation frequency according to a load. As depicted in FIG. 8, when the compressor is operated at a present operation point at a constant speed, if the load variation is not severe, because a phase difference between the compressor speed and the current is within the high efficiency operation region, the operation frequency is not varied. However, when an operation point is greater than the high efficiency operation region due to a load increase, an operation frequency is moved in a solid line direction, when an operation point is smaller than the high efficiency operation region due to a load decrease, an operation frequency is moved in a dotted line direction.

As described in FIG. 8, when a load variation occurs, the operation frequency is varied in order to place the operation point of the compressor 240 within the high efficiency operation region, accordingly an operation efficiency of the compressor 240 can be improved.

Example 2

Figure 9:
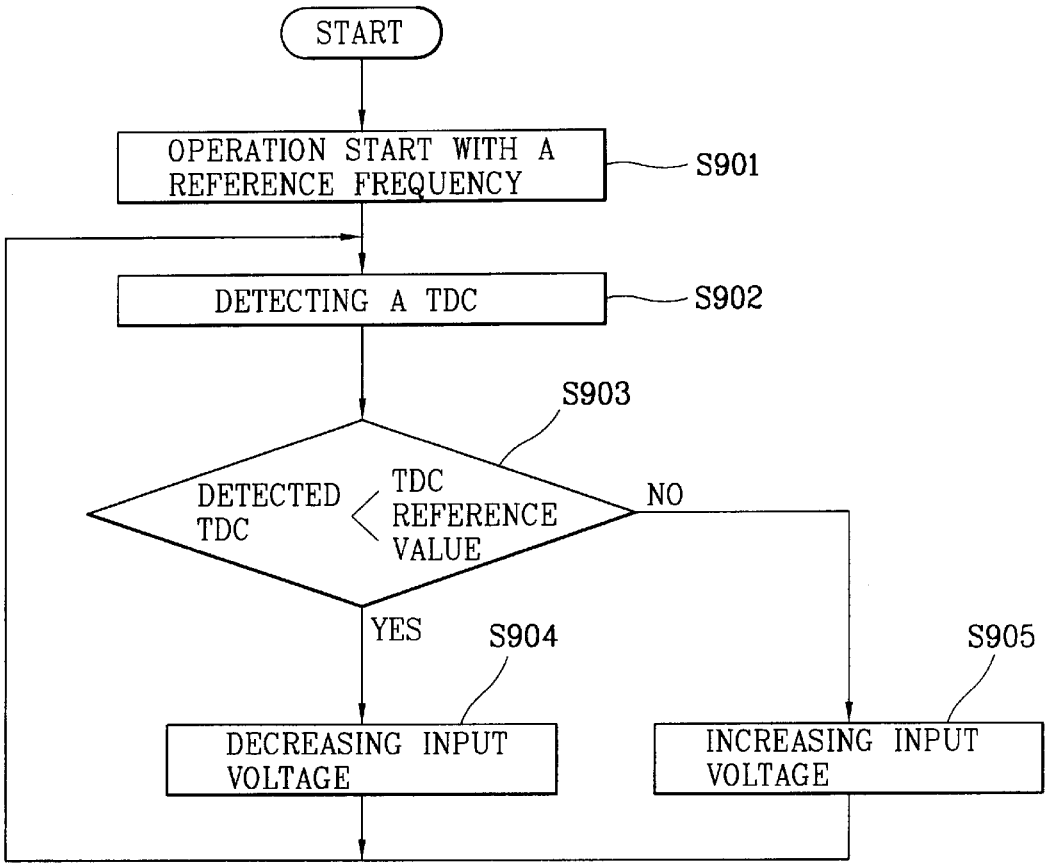
FIG. 9 is a flow chart illustrating a TDC (top dead center) of the operation control apparatus of the compressor in accordance with the present invention.

FIG. 9 is a flow chart illustrating a TDC (top dead center) of the operation control apparatus of the compressor in accordance with the present invention. As depicted in FIG. 9, a TDC (top dead center) of the piston of the compressor 240, a current and a power voltage applied to the compressor 240 are detected by the detecting means 250, the detected TDC is compared with the TDC reference value determined by the operation reference value determining unit 212, a voltage applied to the compressor 240 is controlled so as to compensate the difference according to the comparison result. Simultaneously, a phase difference between a current and a voltage applied to the compressor 240 is calculated, a TDC reference value is increased on the basis of the phase difference until an inflection point occurs on the phase difference curve, and a TDC having a maximum operation efficiency is determined as a TDC reference value. When the TDC reference value is determined, the compressor 240 is continually operated at the point, when a load variation of the compressor 240 occurs, a mechanical resonance frequency of the compressor 240 is varied, an operation point of the compressor 240 is out of the high efficiency operation region, in order to compensate it an operation frequency is varied according to the load variation, accordingly the operation point is returned into the high efficiency operation region.

In more detail, as depicted in FIG. 9, the compressor 240 starts operation with the reference frequency, the detecting means 250 detects a TDC and applies it to the control means 220 as shown at steps S901, S902. Then, the control means 220 receives a TDC reference value applied from the operation reference value determining unit 272 and compares the detected TDC with the TDC reference value. When the detected TDC is greater than the TDC reference value, an input voltage decreases, when the detected TDC is smaller than the TDC reference value, an input voltage increases in order to place the early set operation point within the high efficiency operation region as shown at steps S903~S905. Herein, the high efficiency operation region of the compressor 240 is a region separated as±δ from the point (phase difference=0°).

Herein, the compressor 240 is controlled with the TDC corresponded to a frequency of a power voltage, and the TDC is controlled according to the operation frequency while the compressor 240 is operated.

Figure 10:
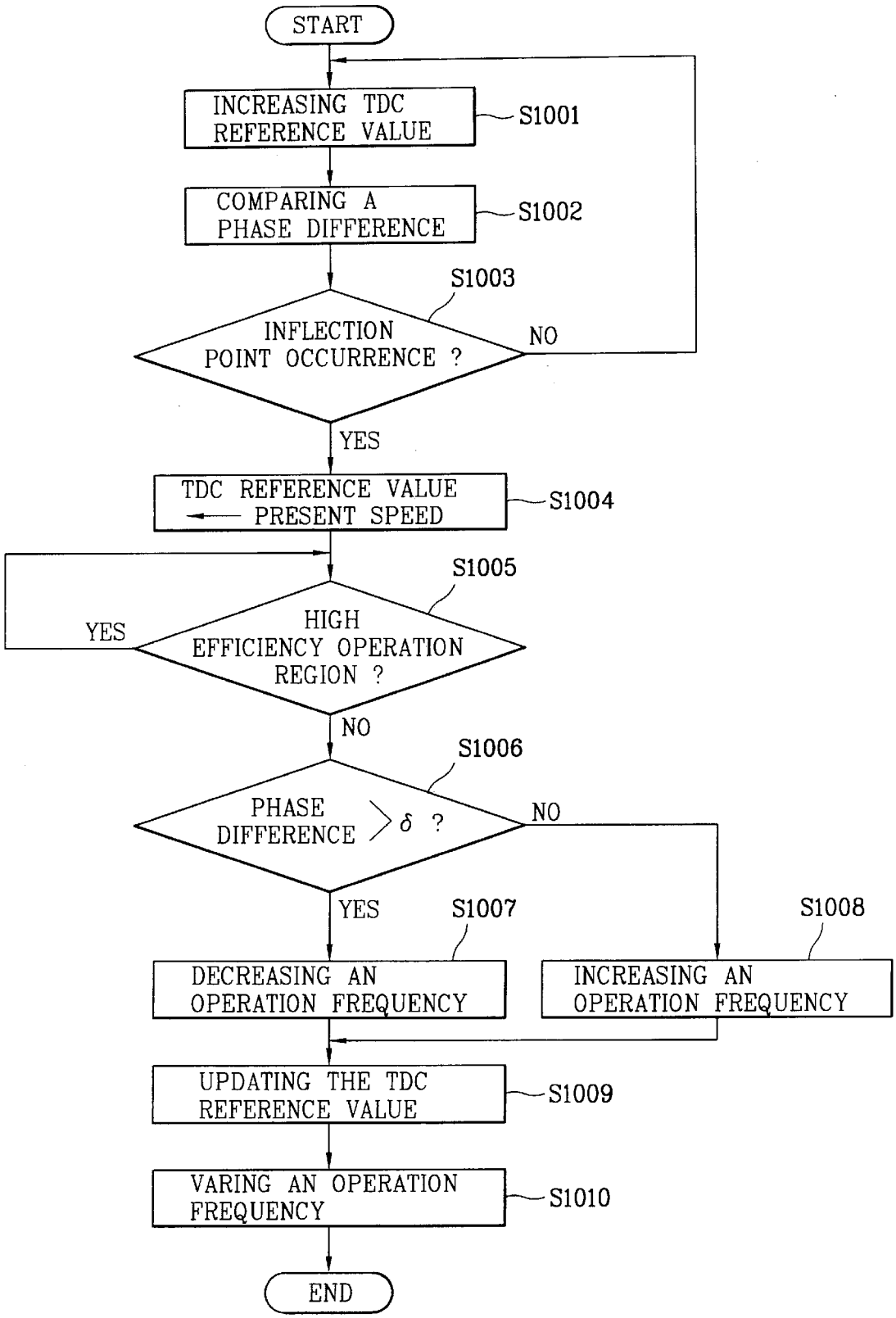
FIG. 10 is a flow chart illustrating an operation control method of a compressor in accordance with another embodiment of the present invention.

As depicted in FIG. 10, the operation reference value determining unit 212 increases the TDC reference value, the phase difference comparing means 260 compares a phase of the current with a phase of the power voltage. If an inflection point on the phase difference curve occurs, a TDC at the point is applied to the operation reference value determining unit 212. Then, the operation reference value determining unit 212 determines the TDC as the TDC reference value and applies it to the control means 220, and the compressor 240 is constantly operated at the TDC through the control method as shown at steps S1001~S1004.

However, when a load variation of the compressor 240 occurs due to the circumstance variation, according to it the mechanical resonance frequency of the compressor 240 increases/decreases. Then, the phase difference comparing means 260 recognizes the load variation through the phase difference between the current and the voltage applied to the compressor 240 and applies a phase difference value according to the load variation to the operation frequency determining unit 271 as shown at step S1005. Then, the operation frequency determining unit 271 determines a compensated operation frequency through the phase difference comparing means 260 and applies it to the operation reference value determining unit 212. In more detail, as depicted in FIGS. 5A and 5B, when the phase difference is greater than an upper limit of the high efficiency operation region, an operation frequency increases, when the phase difference is smaller than a lower limit of the high efficiency operation region, an operation frequency decreases as shown at steps S1006~S1008. Herein, a high efficiency operation region for performing a high efficiency operation is detected through experiments and pre-stored in the storing unit 211. And, a frequency corresponded to the varied operation frequency is determined as a TDC reference value through the storing unit 211 and applied to the control means 220. Then, the control means 220 varies an input frequency applied to the compressor 240, varies an input voltage according to the TDC reference value, accordingly the compressor 240 is continually operated in the high efficiency operation region as shown at steps S1009, S1010.

As described above, in the present invention, a speed is constantly controlled so as to place an operation point of the compressor within a high efficiency operation region by using a phase difference between a piston (compressor) speed and a current, and an operation frequency is varied according to a load variation, accordingly an operation efficiency of the compressor can be improved.

In addition, in the present invention, a TDC is constantly controlled so as to place an operation point of the compressor within a high efficiency operation region by using a phase difference between a power voltage and a current applied to the compressor, and an operation frequency is varied according to a load variation, accordingly an operation efficiency of the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling operation of a compressor, comprising:

a detecting means for detecting a current applied to a compressor and a piston speed of the compressor;

a phase difference comparing means for comparing phases of the current and the speed and outputting a phase difference;

an operation frequency determining means for determining a frequency at a certain time point as an operation frequency by increasing/decreasing a reference operation frequency by a certain frequency units according to the phase difference;

a speed reference value determining means for determining a speed reference value according to the operation frequency outputted from the operation frequency determining means; and a control means for comparing the speed reference value with the speed detected by the detecting means, applying a control signal according to the comparison result to the compressor and varying an operation frequency of the compressor according to the operation frequency determined by the operation frequency determining means.

2. The apparatus of claim 1, wherein the operation frequency determining means includes:

a high efficiency region storing unit for storing a high efficiency operation region at which the compressor performs a stable operation;

a comparing unit for comparing the phase difference detected by the detecting means with the high efficiency operation region in order to check whether the phase difference places within the high efficiency operation region; and an operation frequency determining unit for increasing/decreasing the operation frequency from the reference operation frequency according to the comparison result and setting it as a new operation frequency.

3. The apparatus of claim 2, wherein the operation frequency determining unit increases the operation frequency when a phase difference is greater than an upper limit of the high efficiency operation region.

4. The apparatus of claim 2, wherein the operation frequency determining unit decreases the operation frequency when a phase difference is smaller than a lower limit of the high efficiency operation region.

5. The apparatus of claim 1, wherein the speed reference value determining means includes:

a storing unit for storing a speed reference value by each frequency; and a speed reference value determining unit for determining a speed reference value according to the operation frequency applied from the operation frequency determining means.

6. The apparatus of claim 1, wherein the control means includes:

a comparing unit for comparing the operation reference value applied from the operation reference value determining means with a result value detected from the detecting means, an input voltage varying means for varying a voltage applied to the compressor according to the comparison result; and an operation frequency varying means for varying an operation frequency of the compressor according to the operation frequency applied from the operation frequency determining means.

7. An apparatus for controlling operation of a compressor, comprising:

a detecting means for detecting a current and a voltage applied to a compressor and a TDC (top dead center) through an internal sensor of the compressor;

a phase difference comparing means for comparing phases of the current and the voltage and outputting a phase difference;

an operation frequency determining means for determining a frequency at a certain time point as an operation frequency by increasing/decreasing a reference operation frequency by a certain frequency units according to the phase difference;

a TDC reference value determining means for determining a TDC reference value according to the operation frequency outputted from the operation frequency determining means; and a control means for comparing the TDC reference value with the TDC detected by the detecting means, applying a control signal according to the comparison result to the compressor and varying an operation frequency of the compressor according to the operation frequency determined by the operation frequency determining means.

8. The apparatus of claim 7, wherein the operation frequency determining means includes:

a high efficiency region storing unit for storing a high efficiency operation region at which the compressor performs a stable operation;

a comparing unit for comparing the phase difference detected by the detecting means with the high efficiency operation region in order to check whether the phase difference places within the high efficiency operation region; and an operation frequency determining unit for increasing/decreasing the operation frequency from the reference operation frequency according to the comparison result and setting it as a new operation frequency.

9. The apparatus of claim 8, wherein the operation frequency determining unit increases the operation frequency when a phase difference is greater than an upper limit of the high efficiency operation region.

10. The apparatus of claim 8, wherein the operation frequency determining unit decreases the operation frequency when a phase difference is smaller than a lower limit of the high efficiency operation region.

11. The apparatus of claim 7, wherein the speed reference value determining means includes:

a storing unit for storing a TDC reference value by each frequency; and a TDC reference value determining unit for determining a TDC reference value according to the operation frequency applied from the operation frequency determining means.

12. The apparatus of claim 7, wherein the control means includes:

a comparing unit for comparing the TDC reference value applied from the TDC reference value determining means with a result value detected from the detecting means, an input voltage varying means for varying a voltage applied to the compressor according to the comparison result; and an operation frequency varying means for varying an operation frequency of the compressor according to the operation frequency applied from the operation frequency determining means.

13. A method for controlling operation of a compressor, comprising:

operating a compressor with a reference frequency;

determining a speed at an inflection point as a speed reference value after calculating the inflection point by using a phase difference between a piston speed of a compressor and a current applied to the compressor;

operating the compressor according to the speed reference value; and varying an operation frequency of the compressor when a load variation occurs and varying the speed reference value according to the varied operation frequency.

14. The method of claim 13, wherein the speed reference value determining step includes the sub-steps of:

increasing the speed reference value;

comparing a phase of the piston speed of the compressor with a phase of the current applied to the compressor and calculating a phase difference; and determining a piston speed of the compressor at an inflection point when the inflection point occurs on the phase difference curve in the comparison result.

15. The method of claim 13, wherein the compressor operating step includes the sub-steps of:

detecting a piston speed of the compressor;

comparing the speed with the speed reference value; and increasing a voltage applied to the compressor when the speed reference value is greater than the speed in the comparison result.

16. The method of claim 13, wherein the compressor operating step further includes the sub-step:

decreasing an input voltage applied to the compressor when the speed reference value is smaller than the speed in the comparison result.

17. The method of claim 13, wherein the operation frequency varying step includes the sub-steps of:

comparing whether an operation point of the compressor places within a high efficiency region and varying an operation frequency according to the comparison result; and varying the speed reference value according to the varied operation frequency.

18. The method of claim 17, wherein the operation frequency varying step further includes the sub-step:

detecting a high efficiency region of a phase difference between the speed and the current and storing it.

19. The method of claim 17, wherein it is judged whether a phase difference between the speed and the current is smaller/greater than a certain value in the operation frequency varying step, the operation frequency increase when the phase difference is smaller than the certain value, and the operation frequency decrease when the phase difference is greater than the certain value.

20. The method of claim 19, wherein the certain value is set so as to detect easily an inflection point of a phase difference between the piston speed of the compressor and the current applied to the compressor.

21. A method for controlling operation of a compressor, comprising:

operating a compressor with a reference frequency;

determining a TDC (top dead center) at an inflection point as a TDC reference value after calculating the inflection point by using a phase difference between a power voltage and a current;

operating the compressor according to the TDC reference value; and varying an operation frequency of the compressor when a load variation occurs and varying the TDC reference value according to the varied operation frequency.

22. The method of claim 21, wherein the TDC reference value determining step includes the sub-steps of:

increasing the TDC reference value;

comparing a phase of the power voltage with a phase of the current; and determining a piston speed of the compressor at an inflection point when the inflection point occurs on the phase difference curve in the comparison result.

23. The method of claim 21, wherein the compressor operating step includes the sub-steps of:

detecting a TDC of a piston of the compressor;

comparing the TDC with the TDC reference value; and increasing a voltage applied to the compressor when the TDC reference value is greater than the TDC in the comparison result.

24. The method of claim 23, wherein the compressor operating step further includes the sub-step:

decreasing an input voltage applied to the compressor when the TDC reference value is smaller than the TDC in the comparison result.

25. The method of claim 24, wherein the operation frequency varying step includes the sub-steps of:

comparing whether an operation point of the compressor places within a high efficiency region and varying an operation frequency according to the comparison result; and varying the TDC reference value according to the varied operation frequency.

26. The method of claim 25, wherein the operation frequency varying step further includes the sub-step:

detecting a high efficiency region of a phase difference between the power voltage and the current and storing it.

27. The method of claim 25, wherein it is judged whether a phase difference between the power voltage and the current is smaller/greater than a certain value in the operation frequency varying step, the operation frequency increase when the phase difference is smaller than the certain value, and the operation frequency decrease when the phase difference is greater than the certain value.

28. The method of claim 27, wherein the certain value is set so as to detect easily an inflection point of a phase difference between the piston speed of the compressor and the current applied to the compressor.

* * * * *